US008573164B2

(12) United States Patent
Yamagata

(10) Patent No.: US 8,573,164 B2
(45) Date of Patent: Nov. 5, 2013

(54) PUMP APPARATUS

(75) Inventor: Mitsumasa Yamagata, Toyota (JP)

(73) Assignee: Toyota Jidosha Kabushiki Kaisha, Aichi-ken (JP)

( * ) Notice: Subject to any disclaimer, the term of this patent is extended or adjusted under 35 U.S.C. 154(b) by 432 days.

(21) Appl. No.: 12/906,362

(22) Filed: Oct. 18, 2010

(65) Prior Publication Data

US 2011/0088638 A1 Apr. 21, 2011

(30) Foreign Application Priority Data

Oct. 20, 2009 (JP) ..... 2009-241112

(51) Int. Cl.
*F01P 5/10* (2006.01)

(52) U.S. Cl.
USPC ..... 123/41.44; 123/41.1

(58) Field of Classification Search
USPC ..... 123/41.08–41.1, 41.44–41.46
See application file for complete search history.

(56) References Cited

U.S. PATENT DOCUMENTS

| | | | | |
|---|---|---|---|---|
| 4,662,320 | A * | 5/1987 | Moriya | 123/41.44 |
| 5,044,883 | A * | 9/1991 | Neueder | 415/214.1 |

FOREIGN PATENT DOCUMENTS

| | | | | |
|---|---|---|---|---|
| JP | 60-61498 | U | | 4/1985 |
| JP | 01-85419 | U | | 6/1989 |
| JP | 04-284122 | A | | 10/1992 |
| JP | 05-45335 | U | | 6/1993 |
| JP | 05-47493 | U | | 6/1993 |
| JP | 2560186 | B | | 9/1996 |
| JP | 09-013966 | A | | 1/1997 |
| JP | 09013966 | A | * | 1/1997 |

* cited by examiner

*Primary Examiner* — Noah Kamen
(74) *Attorney, Agent, or Firm* — Sughrue Mion, PLLC

(57) ABSTRACT

A pump apparatus installed in a cooling system of an internal combustion engine includes: a first housing member having a generally circular recess portion; a pump rotor placed within the recess portion; and a second housing member that is fixed to the first housing member so as to define a pump operation chamber that corresponds to the recess portion. The first housing member includes a housing body portion in which the recess portion is formed, and a discharge-side cylindrical portion formed integrally with the housing body portion so as to define a discharge passageway of the cooling water. The second housing member includes a cover portion that covers an opening end side of the recess portion, and a suction-side cylindrical portion that is formed integrally with the cover portion so as to define a suction passageway of the cooling water.

7 Claims, 4 Drawing Sheets

PUMP APPARATUS

INCORPORATION BY REFERENCE

The disclosure of Japanese Patent Application No. 2009-241112 filed on Oct. 20, 2009 including the specification, drawings and abstract is incorporated herein by reference in its entirety.

BACKGROUND OF THE INVENTION

1. Field of the Invention

The invention relates to a pump apparatus and, more particularly, to a pump apparatus having a water pump function which is disposed in a cooling system of a vehicle internal combustion engine.

2. Description of the Related Art

Generally in a cooling system of a vehicle internal combustion engine (hereinafter, simply referred to as "engine"), cooling water of the engine (a cooling liquid whose main component is water) is circulated by a water pump, and when the cooling water temperature is high, the cooling water is cooled by a radiator, and when the cooling water temperature is low, the amount of flow of the cooling water that passes through the radiator is restricted by a thermostat. In the engine cooling system, there is often provided a pump apparatus in which a thermostat disposed near a water pump is incorporated into a major member of the water pump. In such a case, the thermostat is incorporated into, for example, a pump housing of the water pump, and is fixed at a predetermined position by fastening the pump housing to an engine block, or is incorporated into a cylindrical water inlet member that forms a suction passageway of cooling water to the water pump, and is fixed at a predetermined position by fastening the water inlet member to a water pump housing that is integrated with a chain cover (chain case).

Known pump apparatuses of this kind are, for example, a pump apparatus in which a pump housing and a chain case are integrated, and entry and exit passageways of cooling water and a bladed wheel chamber as well as a temperature-responsive portion-housing hole of a thermostat are formed in the chain case (e.g., see Japanese Utility Model Application Publication No. 01-85419 (JP-U-01-85419)), and a pump apparatus in which an inlet pipe, a thermostat housing portion, an impeller chamber and a swirl chamber are integrated with the pump housing (e.g., see Japanese Patent Application Publication No. 09-13966 (JP-A-09-13966)). Furthermore, a pump apparatus in which a suction passageway, a thermostat housing portion and a pump housing portion are formed in the pump housing that is fixed to an engine cylinder head and a thermostat entry-side lid is integrated with a pump lid (e.g., see Japanese Patent Application Publication No. 04-284122 (JP-A-04-284122)).

However, in the pump apparatuses as described above, a recess portion that houses a pump rotor, such as a centrifugal pump impeller or the like, and that defines a swirl chamber or the like is formed in the water pump housing, so that it is necessary to provide a cover that covers the opening of the recess portion and that has a bearing hole for the pump rotor, and an inlet member that forms a cooling water suction passageway on a bottom side of the recess portion, separately from the pump housing. Thus, the housing of the water pump in the related art has a three-division structure whose main component parts are divided into three parts.

Therefore, a plurality of large gasket seals need to be provided in connecting portions between these main component parts of the housing, thus leading to an increased cost of the pump apparatus. In addition, even if sub-assembly, such as the incorporation of a thermostat or the like, is performed, it is necessary to perform an operation of attaching a plurality of large gasket seals, and therefore it is not easy to reduce the number of man-hours for assembling the engine.

SUMMARY OF THE INVENTION

The invention provides a low-cost pump apparatus that is capable of reducing the man-hours for assembling an engine by simplifying the divided structure of main components of the housing of the pump apparatus.

An aspect of the invention relates to a pump apparatus that is installed in a cooling system of an internal combustion engine which circulates cooling water. This pump apparatus includes: a first housing member having a generally circular recess portion; a pump rotor that is placed within the recess portion and that is rotatably supported by the first housing member; and a second housing member that is fixed to an opening end side of the recess portion of the first housing member so as to define, together with the first housing member, a pump operation chamber that corresponds to the recess portion. The first housing member includes a housing body portion in which the recess portion is formed, and a discharge-side cylindrical portion that is formed integrally with the housing body portion so as to define a discharge passageway of the cooling water from the pump operation chamber. The second housing member includes a cover portion that covers the opening end side of the recess portion, and a suction-side cylindrical portion that is formed integrally with the cover portion so as to define a suction passageway of the cooling water.

Due to this construction, the discharge passageway is completely incorporated into the first housing member, while the second housing member that defines the suction passageway is formed integrally the suction passageway-side chamber wall of the pump operation chamber. Therefore, the structure of the housing of the pump apparatus is simplified into a two-division structure whose main component parts are divided into two parts. Therefore, neither the suction passageway of cooling water nor the discharge passageway of cooling water is not divided. Hence, the need to use a plurality of large gasket seals as in the related art is eliminated, so that it is possible to reduce the cost of the pump apparatus and the man-hours for the assembly thereof.

In the foregoing pump apparatus, the cooling system may include a thermostat that is capable of restricting amount of flow of the cooling water sucked from an upstream side to a pump operation chamber side, at an intermediate position in the suction passageway, and the thermostat is supported by the suction-side cylindrical portion of the second housing member so as to be positioned at an intermediate position in the suction passageway.

Due to this construction, it is possible to incorporate the thermostat into the second housing member of the pump apparatus beforehand and therefore reduce the man-hours for assembly.

Besides, the cooling system may further include a radiator that cools the cooling water, and the thermostat may adjust proportion of the amount of flow of the cooling water that passes through the radiator to the amount of flow of the cooling water that comes out from the internal combustion engine, according to the temperature of the cooling water.

Due to this construction, it is possible to shorten the warm-up time of the internal combustion engine and maintain the operation temperature of the engine within a proper range by adjusting the temperature of the cooling water into a suitable range.

In the foregoing pump apparatus, the cooling water having passed through the radiator may be sucked into the suction passageway at an upstream side of the thermostat, and the second housing member may have a connection port that connects another passageway and the suction passageway at a downstream side of the thermostat so that the cooling water having bypassed the radiator is introduced into the suction passageway at the downstream side of the thermostat.

Due to this construction, the pump apparatus becomes capable of being adapted to various types of internal combustion engines if the second housing member, of the main members of the housing of the pump apparatus, is fabricated according to the mounting of the thermostat and the configuration of the connection port.

In the foregoing pump apparatus, the pump rotor may urge the cooling water in a centrifugal direction by rotation of the pump rotor, and the discharge passageway may have an opening in an inner peripheral wall surface of the first housing which forms the recess portion.

Due to the construction, the direction of the suction passageway at a site immediately upstream of the pump operation chamber is close to the direction of the axis of the pump rotor, so that a swirl chamber or the like can easily be formed by the second housing member.

In the pump apparatus, the second housing member may be formed so that a downstream-side passageway portion of the suction passageway which is located at the downstream side of the thermostat is larger in diameter than an upstream-side passageway portion of the suction passageway which is located at the upstream side of the thermostat, and the downstream-side passageway portion may have a frustum shape portion that becomes larger in diameter toward the downstream side, and a downstream-side end portion of the second housing member which closes the recess portion may be made gradually larger in diameter toward the downstream side, corresponding to the frustum shape portion of the downstream-side passageway portion.

Due to the construction, the connection port that connects the another piping passageway to the suction passageway at the downstream side of the thermostat can easily be designed, and the thermostat can easily be attached within the second housing by inserting it thereinto from the downstream end side of the suction passageway.

According to the invention, since the division structure of the housing of the pump apparatus that is divided into the main component parts is simplified by a construction in which the suction passageway-side chamber wall of the pump operation chamber is formed by the second housing member, the need to divide the suction passageway of cooling water or the discharge passageway of cooling water is eliminated, eliminating events in which it is necessary to provide a plurality of large gasket seals. Thus, the cost of the pump apparatus and the man-hours for assembly can be reduced. Hence, it is possible to provide a low-cost pump apparatus that is able to reduce the man-hours for the assembly of the engine.

BRIEF DESCRIPTION OF THE DRAWINGS

The features, advantages, and technical and industrial significance of this invention will be described in the following detailed description of example embodiments of the invention with reference to the accompanying drawings, in which like numerals denote like elements, and wherein.

DETAILED DESCRIPTION OF EMBODIMENTS

Figure 3:
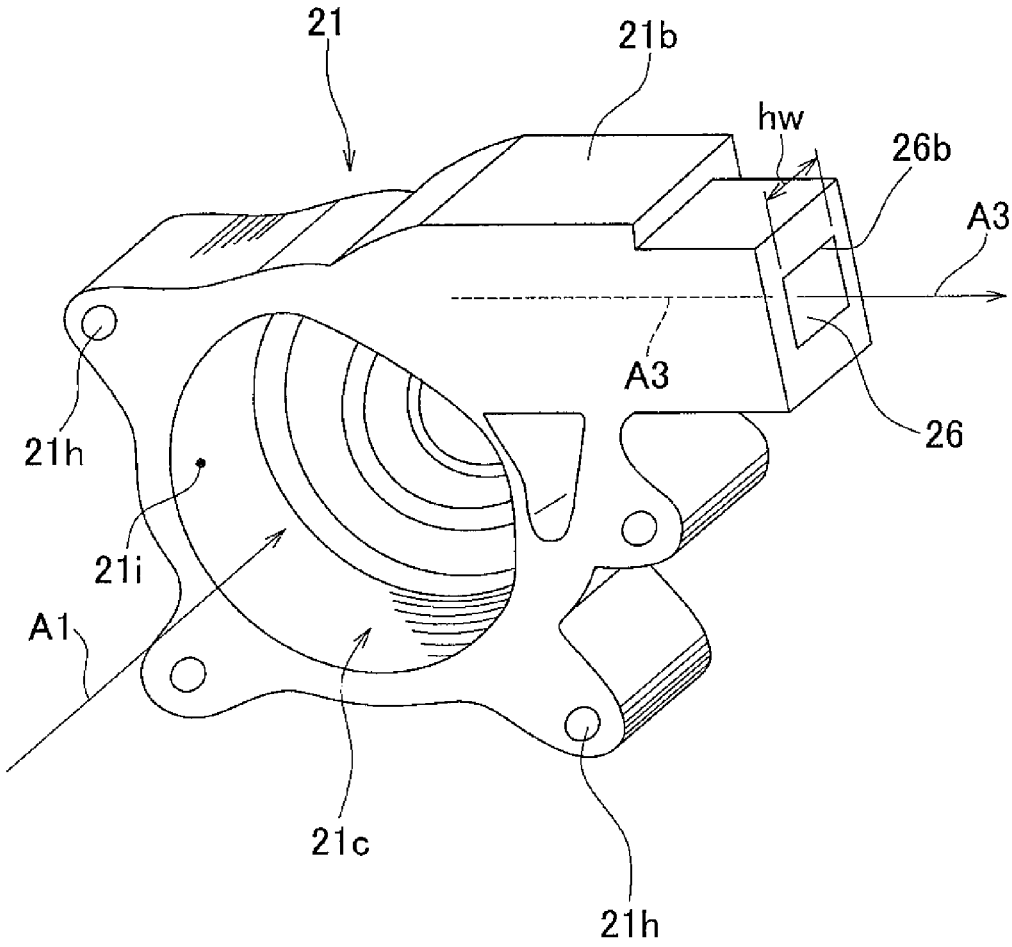
FIG. 3 is a perspective view showing a general configuration of a first housing member of the pump apparatus in accordance with an embodiment o the invention, and flowing directions of cooling water.
Figure 4:
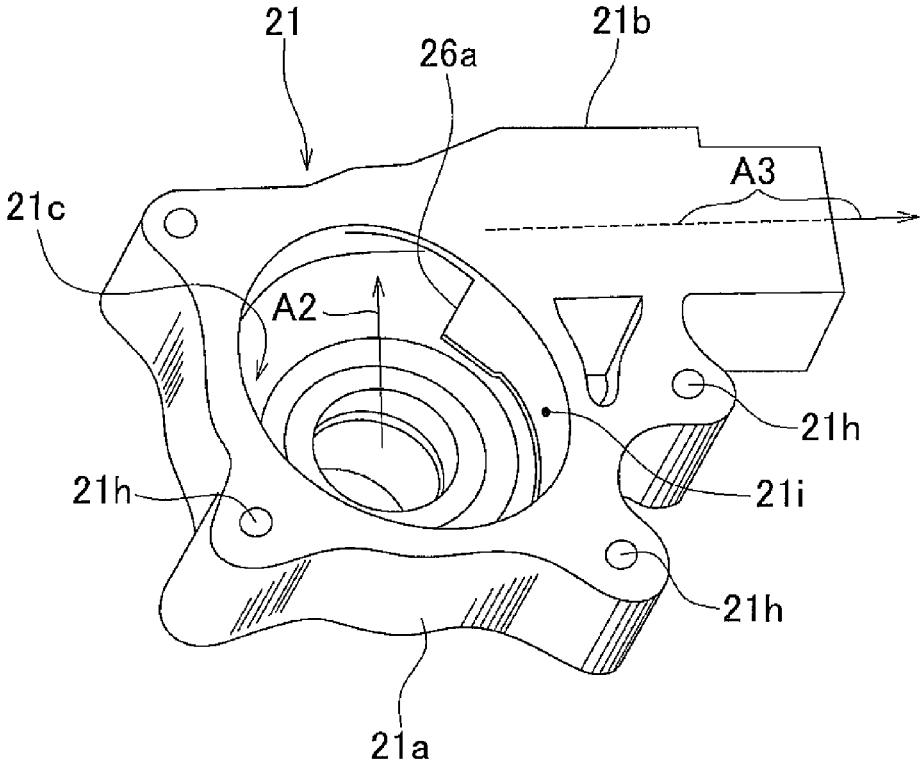
FIG. 4 shows a general construction of the first housing member of the pump apparatus in accordance with the embodiment of the invention, and flowing directions of cooling water, in a perspective view that is taken in a direction that is different from the direction of the perspective view shown in FIG. 3.
Figure 5:
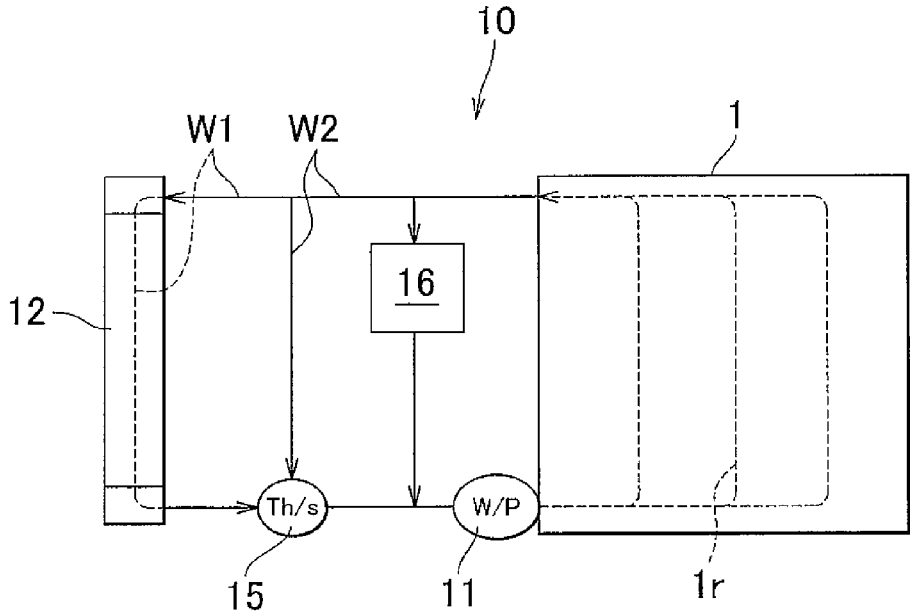
FIG. 5 is a schematic construction diagram of a cooling system of an internal combustion engine which is equipped with a pump apparatus in accordance with an embodiment of the invention.

In a pump apparatus in accordance with an embodiment of the invention shown in FIGS. 1 to 4 is disposed in an engine cooling system 10 (a cooling system of an internal combustion engine) whose general construction is shown in FIG. 5. This engine cooling system 10 is mounted together with an engine 1 shown in FIG. 5 in a vehicle (not shown).

As shown in FIG. 5, the engine cooling system 10 includes a water pump 11 that pumps cooling water to an interior of the engine 1, which is an internal combustion engine, and that circulates the cooling water in a circulation pathway (described later); a radiator 12 through which cooling water from the engine 1 can be passed; and a thermostat 15 capable of restricting the amount of flow of cooling water that passes through a first circulation pathway W1 that passes through the radiator 12 in response to the temperature of the cooling water that passes through a second circulation pathway W2 that bypasses the radiator 12. Besides, in this engine cooling system 10, a cabin-side heater (heating heat exchanger) 16 is also connected to the piping. The cabin-side heater 16 is able to heat air that is to be taken into the cabin as the cooling water from the engine 1 is passed through the cabin-side heater 16.

The water pump 11, which will be detailed later, sucks the cooling water having been subjected to heat exchange in the radiator 12 and/or the cooling water having bypassed the radiator 12, and pumps the cooling water into the engine 1, when the water pump 11 is driven by motive power from the engine 1.

The radiator 12 is a heat exchanger that cools the cooling water that has passed through a water jacket 1*w* (not shown in detail) that is a cooling passageway provided in the engine 1 by heat exchange with air that is supplied as cooing wind.

Although not shown in detail, the first circulation pathway W1 is a piping passageway that provides a communication between the cooling passageway in the engine 1 and a heat exchange passageway in the radiator 12 (not shown in detail). The second circulation pathway W2 has a piping passageway that bypasses the radiator 12.

The thermostat 15 is disposed at a suction side of the water pump 11 so as to be sensitive and responsive to the temperature of the cooling water that passes through the second circulation pathway W2, and is able to adjust the amount of flow of cooling water passing through the radiator 12, in accordance with the cooling water temperature.

Figure 1:
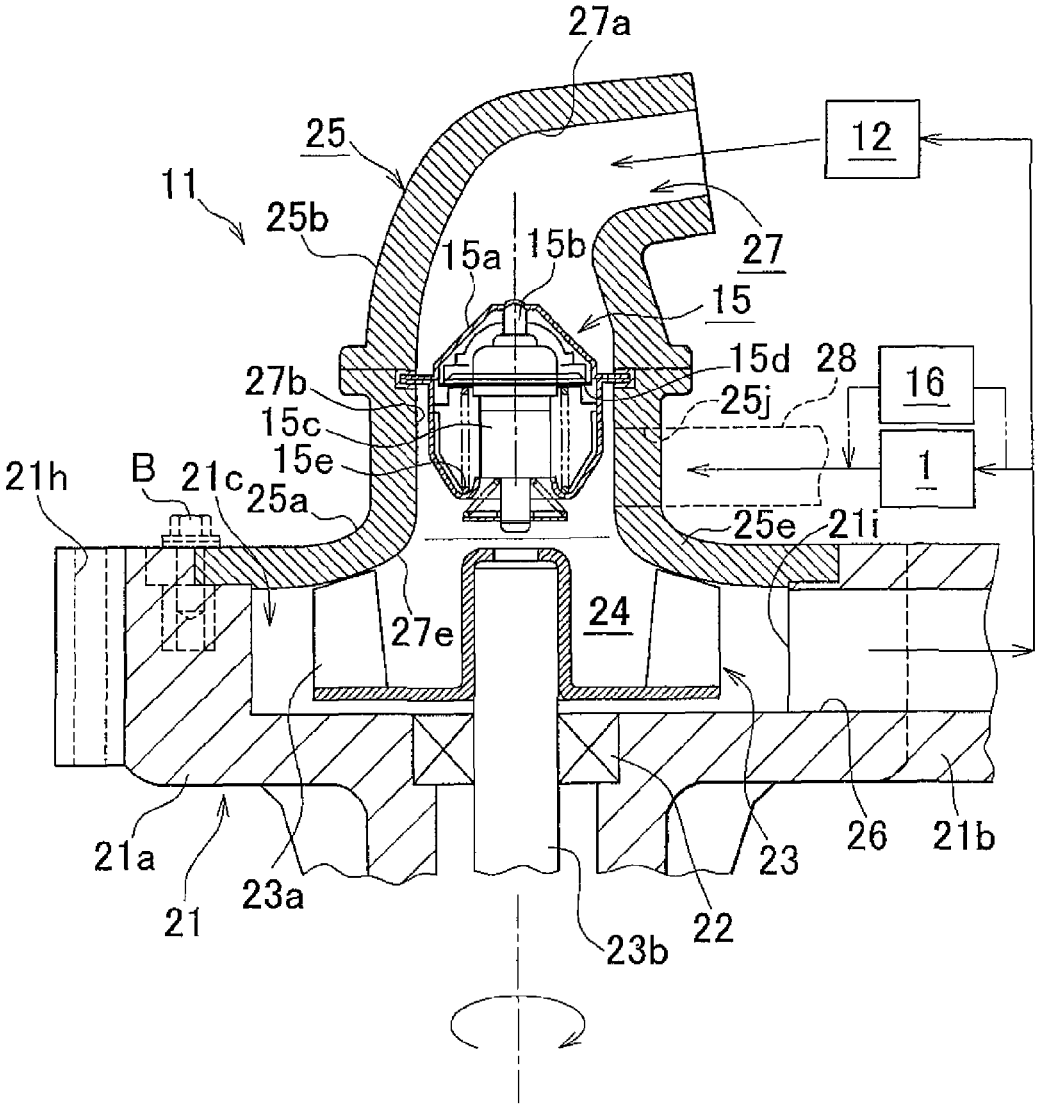
FIG. 1 is a sectional view of a pump apparatus in accordance with an embodiment of the invention.

This thermostat 15 has a construction, for example, as shown in FIG. 1, that includes a flange frame 15*a* whose outer peripheral portion is supported at a suction side of the water pump 11 and whose inner peripheral portion has an annular valve seat (not denoted by a reference character), a stationary rod 15*b* that is fixed to an end portion of the flange frame 15*a* in the axis direction and is protruded toward a center side, a heat responsive portion 15*c* in which the stationary rod 15*b* is inserted and a thermo-max (not shown) is housed, a valve portion 15*d* attached to an outer peripheral side of the heat responsive portion 15*c*; and a compressed coil spring 15*e* that urges the heat responsive portion 15*c* and the valve portion 15*d* in the valve closing direction.

That is, the thermostat 15 is constructed as a valve that opens and closes and changes in the degree of opening as the thermo-wax, which is responsive to heat, changes in volume. According to volume changes of the thermo-wax in the heat responsive portion 15*c*, the heat responsive portion 15*c* is displaced in the axis direction relative to the stationary rod 15*b* to open or close the valve portion 15*d*.

Because of this construction, the engine cooling system 10 is able to circulate the cooling water of the engine 1 by using the water pump 11, and cool the cooling water by the radiator 12 when the temperature of the cooling water rises to a temperature at which the volume of the thermo-wax starts to expand.

A pump apparatus in the embodiment which is disposed in the engine cooling system 10 has a construction as shown in FIG. 1, in which the thermostat 15 is incorporated in the suction side of the water pump 11.

Concretely, the water pump 11 has: a first housing member 21 that is provided with a generally circular recess portion 21*c*; a pump rotor 23 that is housed in the recess portion 21*c* and that is rotatably supported by the first housing member 21 via a shaft bearing 22; and a second housing member 25 fixed to an opening end side of the recess portion 21*c* of the first housing member 21 so that the second housing member 25, together with the first housing member 21, defines a pump operation chamber 24 that corresponds to the recess portion 21*c*. An axis of the pump rotor 23 and an axis of the thermostat 15 substantially coincide with each other.

As shown in FIG. 1, FIG. 3 and FIG. 4, the first housing member 21 includes a housing body portion 21*a* in which the recess portion 21*c* is formed, and a discharge-side cylindrical portion 21*b* that is formed integrally with the housing body portion 21*a* so as to define a discharge passageway 26 that conducts cooling water from the pump operation chamber 24. The first housing member 21 is a main housing member of the water pump 11. An outer peripheral portion of the housing body portion 21*a* has a plurality of protrusions, for example, four protrusions, that are protruded in radial directions so as to be used for fastening and fixing the water pump 11 to a portion of an engine block of the engine 1. Each of the protrusions has a bolt hole 21*h*.

Figure 2:
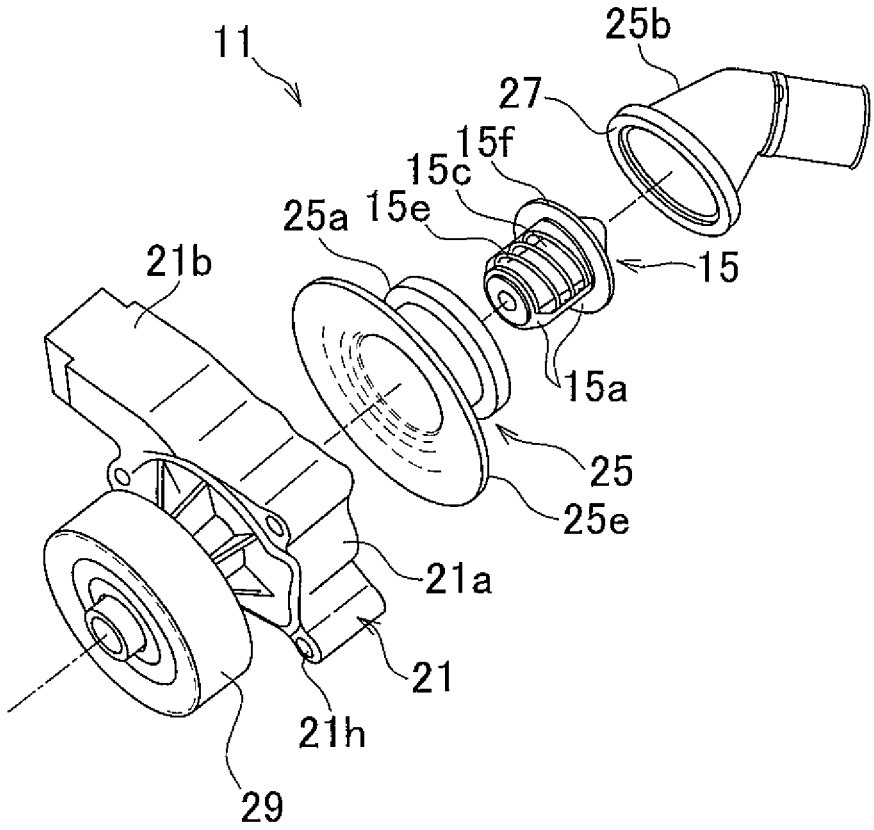
FIG. 2 is an exploded perspective view of a pump apparatus in accordance with an embodiment of the invention.

The second housing member 25, as shown in FIGS. 1 and 2, includes a cover portion 25*a* that covers the opening end side of the recess portion 21*c* of the first housing member 21, and a suction-side cylindrical portion 25*b* that is formed integrally with the cover portion 25*a* so as to define a suction-side passageway 27 of cooling water. The second housing member 25 is a water inlet member in which the thermostat 15 is placed, as described below.

The pump rotor 23 includes a pump impeller portion 23*a* that urges cooling water in centrifugal directions when rotating, and a rotor shaft portion 23*b* (see FIG. 1) that is rotated and driven by motive power from the engine 1 via a pulley 29 shown in FIG. 2. When the engine 1 is operated, the pump rotor 23 is driven at a constant rotation speed ratio to the engine rotation speed [rpm].

As shown in FIG. 1, FIG. 3 and FIG. 4, an opening of an inner end portion 26*a* of the discharge passageway 26 is formed in an inner peripheral wall surface 21*i* of the recess portion 21*c* of the first housing member 21 so that the cooling water discharged from the pump rotor 23 is taken into the discharge passageway 26 in a specific range in the rotation angle of the pump rotor 23. The opening of the inner end portion 26*a* has an opening width that is larger than a passageway width hw of the discharge passageway 26 (see FIG. 3). Besides, the discharge passageway 26 extends from its inner end portion 26*a* substantially in a direction tangential to the outer periphery of the pump rotor 23. As shown in FIG. 3, an outer end portion 26*b* of the discharge passageway 26 which is located at an outer end side of the discharge-side cylindrical portion 21*b* has a generally rectangular shape (which may also be a generally oval or elliptical shape).

The second housing member 25 is formed so as to have a generally skirt shape in which a downstream-side passageway portion 27*b* of the suction passageway 27 which is located at a downstream side of the thermostat 15 is larger in diameter than an upstream-side passageway portion 27*a* of the suction passageway 27 which is located at an upstream-side of the thermostat 15. The downstream-side passageway portion 27*b* has a frustum shape portion 27*e* whose diameter becomes larger toward the downstream side. Besides, a downstream-side end portion 25*e* of the second housing member 25 is made gradually larger in diameter (the diameter thereof is made gradually larger) toward the downstream side like a bugle horn, corresponding to the frustum shape portion 27*e* of the downstream-side passageway portion 27*b*.

Furthermore, the second housing member 25 has a connection port 25*j* that connects another piping passageway 28 to the downstream-side passageway portion 27*b* of the suction passageway 27 at the downstream side of the thermostat 15 so that the cooling water having bypassed the radiator 12 is introduced into the downstream-side passageway portion 27*b* of the suction passageway 27 via the connection port 25*j* while the cooling water having passed through the radiator 12 is sucked into the upstream-side passageway portion 27*a* of the suction passageway 27. The another piping passageway 28 is, for example, a bypass passageway that is a portion of the second circulation passageway W2 and therefore bypasses the radiator 12.

The thermostat 15 is supported at an internal site in the suction-side cylindrical portion 25*b* of the second housing member 25 so as to be positioned in an intermediate portion of the suction passageway 27. Specifically, the thermostat 15, located at a fixed position in an intermediate portion of the suction passageway 27, restricts the amount of flow of cooling water sucked from the radiator 12 side, that is, the upstream side, to the pump operation chamber 24 side. That is, the thermostat 15 is able to adjust the proportion of the amount of flow of cooling water that passes through the radiator 12 to the amount of flow of cooling water that flows out from the engine 1, according to the temperature of the cooling water at the heat responsive portion 15*c* side.

Incidentally, in this embodiment, the cover portion 25*a* that forms a chamber wall portion of a swirl chamber of the water pump 11, and the suction-side cylindrical portion 25*b* as a water inlet member are separately molded beforehand, and when the upstream-side end portion of the cover portion 25*a* and the downstream-side end portion of the suction-side cylindrical portion 25*b* are integrally crimped to each other, the thermostat 15 is placed and fixed at an intermediate position in the suction passageway 27 that is an internal position within the second housing member 25. However, it is also permissible to employ other methods. For example, the cover portion 25*a* and the suction-side cylindrical portion 25*b* of the second housing member 25 may be integrally molded beforehand, and the thermostat 15 may be inserted into the second housing member 25 from the frustum shape portion 27*e* side, that is, from the downstream end of the suction passageway 27, and an outer peripheral flange portion 15*f* of the thermostat 15 may be snap-fitted to an inner wall of the second housing member 25, that is, the outer peripheral flange portion 15*f* of the thermostat 15 and the inner wall of the second housing member 25 may be provided with suitable recesses and protrusions or elastically deformable portions for the snap-fitting therebetween.

Besides, the first housing member 21 and the second housing member 25 can be molded of various materials, for example, resins, die-casting alloys such as aluminum die-casting alloys, aluminum casting alloys, etc. The method for joining the first housing member 21 and the second housing member 25 is not particularly limited. For example, welding or snap fitting may be adopted as the joining method, and bolt fastening via a gasket seal may also be adopted.

Although not shown in detail, the second housing member 25 has an annular fixture region that is crimped or welded or adhered to a portion of the first housing member 21 that is adjacent to the opening end edge of the recess portion 21*c* of the first housing member 21, or has fastening regions and an annular crimping region that are fastened with bolts B (see FIG. 1) so as to be crimped to the first housing member 21 via a seal ring or a gasket seal.

Besides, the second housing member 25 may be fitted to the opening end portion of the recess portion 21*c* of the first housing member 21 by, for example, a spigot-and-socket joint structure, and then firm fixation or sealing may be performed between a pair of annular surface portions of the first housing member 21 and the second housing member 25 that face each other in the axis direction and/or between a pair of cylindrical surfaces of the two members that face each other in the radial direction.

In FIGS. 3 and 4, an arrow A1 extending from outside the first housing member 21 into the recess portion 21*c* shows a general direction in which cooling water is sucked into the pump operation chamber 24, and an arrow A2 extending from a central portion of the recess portion 21*c* to an inner end portion 26*a* side shows a direction in which cooling water is urged by the pump rotor 23, and an arrow A3 passing through the discharge passageway 26 shows a discharge direction in which cooling water is discharged from the pump operation chamber 24 through the discharge passageway 26.

Next, operation of this embodiment will be described.

In this embodiment, the thermostat 15 disposed near the water pump 11 is incorporated beforehand into the second housing member 25, which corresponds to a water inlet member of the water pump 11. The assembly of the pump apparatus is completed by joining the second housing member 25 to the first housing member 21 in which the pump rotor 23 is placed.

In this case, the discharge passageway 26 is completely incorporated into the first housing member 21 by forming the discharge-side cylindrical portion 21*b* integrally with the first housing member 21, while the second housing member 25 that defines the suction passageway 27 is formed integrally with the cover portion 25*a* that serves as the suction passageway 27-side chamber wall of the pump operation chamber 24. Therefore, the structure of the housing of the pump apparatus is simplified into a two-division structure whose main component parts are divided into the first housing member 21 and the second housing member 25. Besides, neither the suction passageway 27 of cooling water nor the discharge passageway 26 of cooling water is divided. Therefore, the need to use a plurality of large gasket seals as in the related art is eliminated, so that it is possible to reduce the cost of the pump apparatus and the man-hours for the assembly thereof.

Besides, in this embodiment, since the thermostat 15 is supported by the suction-side cylindrical portion 25*b* of the second housing member 25 so as to be positioned in an intermediate portion of the suction passageway 27, it is possible to incorporate the thermostat 15 into the second housing member 25 of the pump apparatus beforehand and therefore reduce the man-hours for assembly.

Furthermore, since the proportion of the amount of flow of cooling water that passes through the radiator 12 to the amount of cooling water that flows out from the engine 1 is adjusted by the thermostat 15 according to the temperature of the cooling water, it is possible to shorten the warm-up time of the engine 1 and maintain the operation temperature of the engine 1 within a proper range by adjusting the temperature of the cooling water into a suitable range.

In addition, since the second housing member 25 has the connection port 25*j* that connects the another piping passageway 28 to the suction passageway 27 at the downstream side of the thermostat 15, the pump apparatus of this embodiment is capable of being adapted to various types of engines 1 by fabricating the second housing member 25, of the two main members of the housing of the pump apparatus, according to the mounting of the thermostat 15 and the configuration of the connection port.

Besides, since cooling water is urged in centrifugal directions by rotation of the pump rotor 23, and since the discharge passageway 26 has an opening in the inner peripheral wall surface 21*i* of the first housing member 21 which defines the recess portion 21*c*, the direction of the suction passageway 27 at a site immediately upstream of the pump operation chamber 24 is close to the direction of the axis of the pump rotor 23, so that a swirl chamber or the like can easily be defined or formed by the second housing member 25.

Furthermore, the downstream-side passageway part 27*b* of the suction passageway 27 has the frustum shape portion 27*e* whose diameter becomes larger toward the downstream side, and the downstream-side end portion 25*e* of the second housing member 25 is made gradually larger in diameter toward the downstream side, corresponding to the shape of the frustum shape portion 27*e* of the suction passageway 27. Therefore, the connection port 25*j* that connects the another piping passageway 28 to the suction passageway 27 at the downstream side of the thermostat 15 can easily be designed, and the thermostat 15 can easily be attached to an inner wall portion of the second housing member 25 by inserting it thereinto from the downstream end side of the suction passageway 27.

After the assembling of the pump apparatus and the mounting of the pump apparatus to the engine 1 are completed, the water pump 11 is driven during operation of the engine 1, so that cooling water is circulated in at least one of the first circulation pathway W1 and the second circulation pathway W2. Then, for example, when the cooling water temperature is high, the cooling water passing through the first circulation pathway W1 is cooled by the radiator 12. When the cooling water temperature is low, the amount of flow of cooling water that passes through the radiator 12 is restricted by the thermostat 15, so that the temperature of the cooling water that passes through the first circulation pathway W1 is quickly raised and therefore the engine 1 is rapidly warmed up.

Thus, in this embodiment, since the division structure of the housing of the pump apparatus that is divided into the two main component parts is simplified by a construction in which the suction passageway 27-side chamber wall of the pump operation chamber 24 is formed by the second housing member 25, the need to divide the suction passageway 27 of cooling water or the discharge passageway 26 of cooling water is eliminated, solving the problem of the division structure making it necessary to provide a plurality of large gasket seals. Thus, the cost of the pump apparatus and the man-hours for assembly can be reduced. Hence, it is possible to provide a low-cost pump apparatus that is able to reduce the man-hours for the assembly of the engine 1.

Besides, although in the foregoing embodiment, the thermostat 15 uses wax, it should be apparent that in the invention any open-close device that is responsive to the cooling water temperature can be used. Besides, the impeller configuration of the pump rotor 23 is arbitrary. Furthermore, the invention is not limited to a construction in which the configuration of the second housing member 25 integrated with the water inlet member is a gentle bell-bottom configuration as shown in FIG. 1. It is also permissible to adopt a construction in which the suction passageway 27 is made larger in diameter at an arbitrary intermediate position in the suction passageway 27 at the downstream side of the outer peripheral flange 15*f* of the thermostat 15, and the another piping passageway 28 is connected to a portion of the second housing member 25 that surrounds the radially enlarged portion of the suction passageway 27.

As described above, in the pump apparatus of the embodiment, the division structure of the housing of the pump apparatus in which main component parts are divided is simplified by a construction in which the suction passageway-side chamber wall of the pump operation chamber is formed by the second housing member, the need to divide the suction passageway of cooling water and the discharge passageway of cooling water is eliminated, thus solving the problem of the division structure making it necessary to provide a plurality of large gasket seals. Besides, the cost of the pump apparatus and the man-hours for assembly can be reduced. Hence, it is possible to provide a low-cost pump apparatus that is able to reduce the man-hours for the assembly of the engine. Besides, the invention is useful to pump apparatuses and, particularly, to practically any pump apparatus that has a water pump function and that is installed in the cooling system of an internal combustion engine for a vehicle.

What is claimed is:

1. A pump apparatus that is installed in a cooling system of an internal combustion engine which circulates cooling water of the internal combustion engine and which cools the cooling water according to temperature of the cooling water, the pump apparatus comprising:

a first housing member having a generally circular recess portion;

a pump rotor that is placed within the recess portion and that is rotatably supported by the first housing member; and a second housing member that is fixed to an opening end side of the recess portion of the first housing member so as to define, together with the first housing member, a pump operation chamber that corresponds to the recess portion, wherein the first housing member includes a housing body portion in which the recess portion is formed, and a discharge-side cylindrical portion that is formed integrally with the housing body portion so as to define a discharge passageway of the cooling water from the pump operation chamber, wherein an outer peripheral portion of the housing body portion has a bolt hole configured to fasten and fix the pump apparatus to the internal combustion engine; and wherein the second housing member includes a cover portion that covers the opening end side of the recess portion, and a suction-side cylindrical portion that is formed integrally with the cover portion so as to define a suction passageway of the cooling water, wherein the cooling system includes a thermostat that is capable of restricting amount of flow of the cooling water sucked from an upstream side to a pump operation chamber side, at an intermediate position in the suction passageway, and the thermostat is supported by the suction-side cylindrical portion of the second housing member so as to be positioned at an intermediate position in the suction passageway.

2. The pump apparatus according to claim 1, wherein the cooling system further includes a radiator that cools the cooling water, and the thermostat adjusts proportion of the amount of flow of the cooling water that passes through the radiator to the amount of flow of the cooling water that comes out from the internal combustion engine, according to the temperature of the cooling water.

3. The pump apparatus according to claim 1, wherein:

the cooling water having passed through the radiator is sucked into the suction passageway at an upstream side of the thermostat; and the second housing member has a connection port that connects another passageway and the suction passageway at a downstream side of the thermostat so that the cooling water having bypassed the radiator is introduced into the suction passageway at the downstream side of the thermostat.

4. The pump apparatus according to claim 1, wherein the pump rotor urges the cooling water in a centrifugal direction by rotation of the pump rotor, and the discharge passageway has an opening in an inner peripheral wall surface of the first housing which forms the recess portion.

5. The pump apparatus according to claim 4, wherein:

the second housing member is formed so that a downstream-side passageway portion of the suction passageway which is located at the downstream side of the thermostat is larger in diameter than an upstream-side passageway portion of the suction passageway which is located at the upstream side of the thermostat; and the downstream-side passageway portion has a frustum shape portion that becomes larger in diameter toward the downstream side, and a downstream-side end portion of the second housing member which closes the recess portion is made gradually larger in diameter toward the downstream side, corresponding to the frustum shape portion of the downstream-side passageway portion.

6. The pump apparatus according to claim 1, wherein an axis of the thermostat and an axis of the pump rotor substantially coincide with each other.

7. The pump apparatus according to claim 1, wherein the second housing member is fitted to the opening end portion of the recess portion of the first housing member, and the first housing member and the second housing member are configured to be firmly fixed together by a pair of annular surface portions of the first housing member and the second housing member that face each other in the axis direction and between a pair of cylindrical surfaces of the first housing member and the second housing member that face each other in the radial direction.

* * * * *